US008378893B2

(12) United States Patent
Harokopus

(10) Patent No.: US 8,378,893 B2
(45) Date of Patent: Feb. 19, 2013

(54) PATCH ANTENNA

(75) Inventor: William P. Harokopus, McKinney, TX (US)

(73) Assignee: Raytheon Company, Waltham, MA (US)

( * ) Notice: Subject to any disclaimer, the term of this patent is extended or adjusted under 35 U.S.C. 154(b) by 730 days.

(21) Appl. No.: 12/249,430

(22) Filed: Oct. 10, 2008

(65) Prior Publication Data

US 2009/0096679 A1 Apr. 16, 2009

Related U.S. Application Data

(60) Provisional application No. 60/979,307, filed on Oct. 11, 2007.

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS

| | | | | |
|---|---|---|---|---|
| 5,227,749 | A * | 7/1993 | Raguenet et al. | 333/246 |
| 5,233,364 | A | 8/1993 | Lefeuvre et al. | 343/789 |
| 5,465,100 | A | 11/1995 | Remondiere et al. | 343/769 |
| 5,801,660 | A | 9/1998 | Ohtsuka et al. | 343/700 MS |
| 5,880,694 | A | 3/1999 | Wang et al. | 343/700 |
| 6,061,027 | A | 5/2000 | Legay et al. | 343/700 |
| 6,075,485 | A | 6/2000 | Lilly et al. | |
| 6,211,824 | B1 * | 4/2001 | Holden et al. | 343/700 MS |
| 6,538,618 | B2 | 3/2003 | Yamamoto et al. | 343/789 |
| 6,567,048 | B2 | 5/2003 | McKinzie et al. | 343/700 MS |
| 6,624,787 | B2 | 9/2003 | Puzella et al. | 343/700 |
| 6,768,471 | B2 | 7/2004 | Bostwick et al. | 343/700 MS |
| 6,937,184 | B2 | 8/2005 | Fujieda et al. | 342/70 |
| 7,712,381 | B2 | 5/2010 | Allenberg et al. | |
| 8,159,409 | B2 | 4/2012 | Harokopus et al. | |
| 2003/0122712 | A1 | 7/2003 | Rawnick et al. | 343/700 MS |
| 2004/0036148 | A1 | 2/2004 | Block et al. | |
| 2010/0182217 | A1 | 7/2010 | Harokopus et al. | 343/872 |

FOREIGN PATENT DOCUMENTS

| | | |
|---|---|---|
| EP | 0 720 252 | 7/1996 |
| WO | WO 96/39728 | 12/1996 |
| WO | WO 2007/055028 | 5/2007 |

OTHER PUBLICATIONS

Notification of Transmittal of the International Search Report and the Written Opinion of the International Searching Authority, or the Declaration; for PCT/US2008/079555; 13 pages, Apr. 3, 2009.

Notification of Transmittal of the Int'l Search Report and Written Opinion of the Int'l Searching Authority, or the Declaration; PCT/US2009/069206; (13 pgs), Mar. 15, 2010.

J.R. James et al. "Handbook of Microstrip Antennas", pp. 592-597, Dec. 31, 1989.

P. Bhartia, et al. "Millimeter-Wave Microstrip and Printed Circuit Antennas", pp. 295-300, Dec. 31, 1991.

(Continued)

*Primary Examiner* — Hoang V Nguyen
*Assistant Examiner* — Kyana R McCain
(74) *Attorney, Agent, or Firm* — Daly, Crowley, Mofford & Durkee, LLP

(57) ABSTRACT

According to one embodiment, a patch antenna includes a radiating layer coupled to a feed line. The radiating layer has at least one radiating element disposed on an opposite side from the feed line. The radiating layer has a moat around its perimeter forming an inner perimeter sidewall and an outer perimeter sidewall. A conductive coating may be disposed on the inner perimeter sidewall or the outer perimeter sidewall.

16 Claims, 3 Drawing Sheets

OTHER PUBLICATIONS

Guha, D. et al. Resonant Frequency of Circular Microstrip Antenna Covered with Dielectric Superstrate, vol. 51, No. 7, pp. 1649-1652, Jul. 1, 2003.

Hassani et al. , "Analysis of Triangular Patch Antennas Including Radome Effects"; IEEE Proceedings H. Microwave, Antennas and Propagation, Institution of Electrical Engineers, vol. 139, No. 3 Part H, pp. 251-256, Jun. 1, 1992.

*Response Pursuant to 37 C.F.R. § 1.111*; U.S. Appl. No. 12/356,299; in the name of Harokopus et al., (8 pgs ), date filed Aug. 25, 2011.

*USPTO Office Action*; U.S. Appl. No. 12/356,299; in the name of Harokopus et al. , (10 pgs), Notification date May 26, 2011.

U.S. Appl. No. 12/356,299, filed Jan. 20, 2009; issued as U.S. Pat. No. 8,159,409 on Apr. 17, 2012; 285 pages, Harokopus et al.

* cited by examiner

PATCH ANTENNA

RELATED APPLICATIONS

This application claims priority to U.S. Provisional Patent Application Ser. No. 60/979,307, entitled "PATCH ANTENNA," which was filed on Oct. 11, 2007.

TECHNICAL FIELD OF THE DISCLOSURE

This disclosure generally relates to antennas, and more particularly, to a patch antenna that may be formed on a dielectric substrate.

BACKGROUND OF THE DISCLOSURE

A patch antenna is a type of antenna that has a radiating element suspended over a ground plane. Patch antennas are characterized by their relative ease of manufacture due to their relatively simple structure. The radiating element of the patch antenna may be directly coupled or inductively coupled to a feed line using various known balun structures or other known coupling devices.

SUMMARY OF THE DISCLOSURE

According to one embodiment, a patch antenna includes a radiating layer coupled to a feed line. The radiating layer has at least one radiating element disposed on an opposite side from the feed line. The radiating layer has a moat around its perimeter forming an inner perimeter sidewall and an outer perimeter sidewall. A conductive coating may be disposed on the inner perimeter sidewall or the outer perimeter sidewall.

Some embodiments of the invention provide numerous technical advantages. Some embodiments may benefit from some, none, or all of these advantages. For example, according to one embodiment, a patch antenna having an array of elements of this type may be formed on a single substrate that is relatively cheaper to produce than other patch antenna designs. Known patch antennas configured in arrays provide isolation by fabricating its elements independently of one another. During assembly, these individual elements are assembled on a common substrate using a pick-n-place process, which is generally expensive and time consuming. These known patch antennas may also be isolated by a metal frame which is generally heavy. The patch antenna according to the teachings of the present disclosure may alleviate use of the pick-n-place process by forming a plurality of radiating elements on a common dielectric substrate with plated moats to provide isolation between adjacent elements.

Other technical advantages may be readily ascertained by one of ordinary skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

Patch antennas may be formed using common lithographic patterning techniques on which typical printed circuit boards are made. That is, copper or other conductive coatings on either side of a dielectric material may be etched using a lithographic process to form radiating elements of the patch antenna. Because these patch antennas have a relatively limited radiating power output, a number of patch antennas forming an array may be used to develop the desired power output and pattern shape.

Arrays of multiple patch antennas on the same substrate have been attempted. These arrays, however, may have limited performance due to parasitic surface waves generated between adjacent radiating elements that generally causes a loss in operating efficiency. To solve this problem, arrays of patch antennas have been developed using radiating elements that are formed independently of the substrate onto which they are placed. These radiating elements are generally referred to as substrate pucks and are glued during assembly, to a substrate, made of aluminum, using a pick-n-place process that may be laborious and/or time consuming.

Figure 1A:
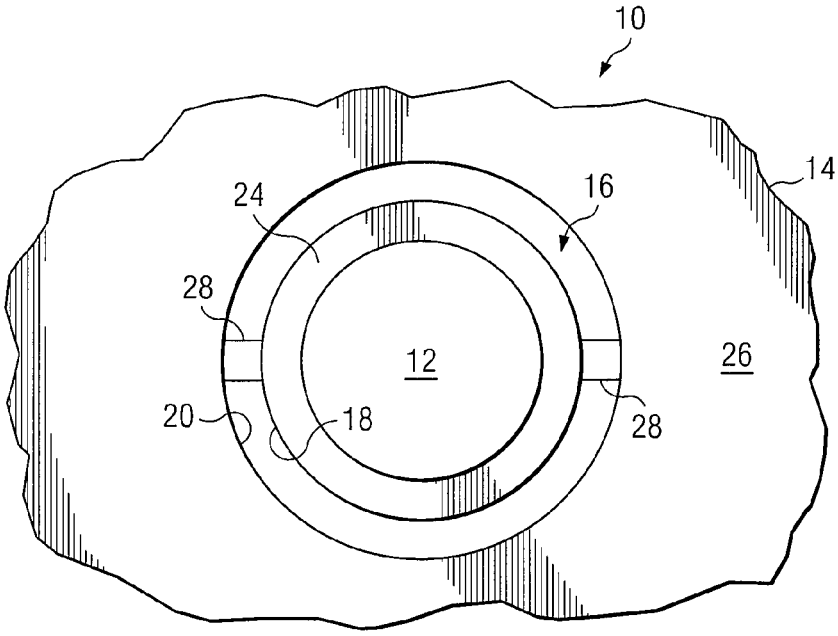
FIG. 1A is a plan view of one embodiment of a radiating layer that may be used to form a patch antenna according to the teachings of the present disclosure.
Figure 1B:
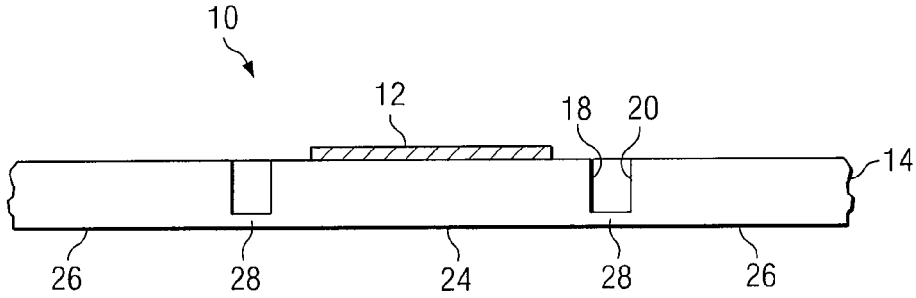
FIG. 1B is a cross-sectional side view of the radiating layer of FIG. 1A.

FIGS. 1A and 1B show one embodiment of a radiating layer 10 of a patch antenna that may provide a solution to this problem as well as other problems. Radiating layer 10 includes at least one radiating element 12 formed on a generally planar-shaped dielectric substrate 14 using a common etching process. A moat 16 is provided that extends around the perimeter of the radiating element 12 to form an inner perimeter sidewall 18 and an outer perimeter sidewall 20. As will be described in detail below, inner perimeter sidewall 18 or outer perimeter sidewall 20 may be coated with a conductive coating which, in some embodiments, may be operable to electrically isolate radiating element 12 from other radiating elements formed on the same dielectric substrate 14.

Moat 16 is an elongated through-hole in the dielectric substrate formed using conventional printed circuit board processing techniques, such as by a routing process. Moat 16 forms an inner substrate portion 24 and an outer substrate portion 26. Fabrication of moat 16 creates inner perimeter sidewall 18 and outer perimeter sidewall 20 that may be plated with a conductive coating made of a conductive material, such as metal. The conductive coating forms an isolation barrier of radiating element 12 from other radiating elements formed on dielectric substrate 14.

Tabs 28 may be included to maintain inner substrate portion 24 in a fixed physical relationship to outer substrate portion 26. Tabs 28 are formed during creation of moat 16 in which a relatively small portion of dielectric material remains following the routing process. Thus, radiating element 12 may be formed using a common etching and routing process on a dielectric substrate 14 while the moats 16 provide relatively improved isolation from other radiating elements disposed nearby.

Dielectric substrate 14 may be formed of any suitable insulative material. In one embodiment, dielectric substrate 14 may be made of a flame resistant 4 (FR4) material. The dielectric substrate 14 may be initially provided with a coating of copper or other conductive material on one or both of its sides. Manufacture of the patch antenna 10 may be provided using a commonly known lithographic process whereby selective regions of the conductive material may be etched away to form the radiating element 12.

Certain embodiments incorporating a lithographic process may provide an advantage over other known processes for manufacturing patch antennas. Using this lithographic technique, the size, shape, and relative placement of the radiating element 12 on the dielectric substrate 14 may be maintained within relatively tight specifications. The lithographic technique may also provide a patch antenna 10 that is relatively cheaper to produce than known patch antennas manufactured using the pick-n-place process.

In this particular embodiment, radiating elements have a circular shape; however, other embodiments of radiating elements 12 may have any suitable geometrical shape, including a square shape, an octagonal shape, and a rectangular shape.

Figure 2:
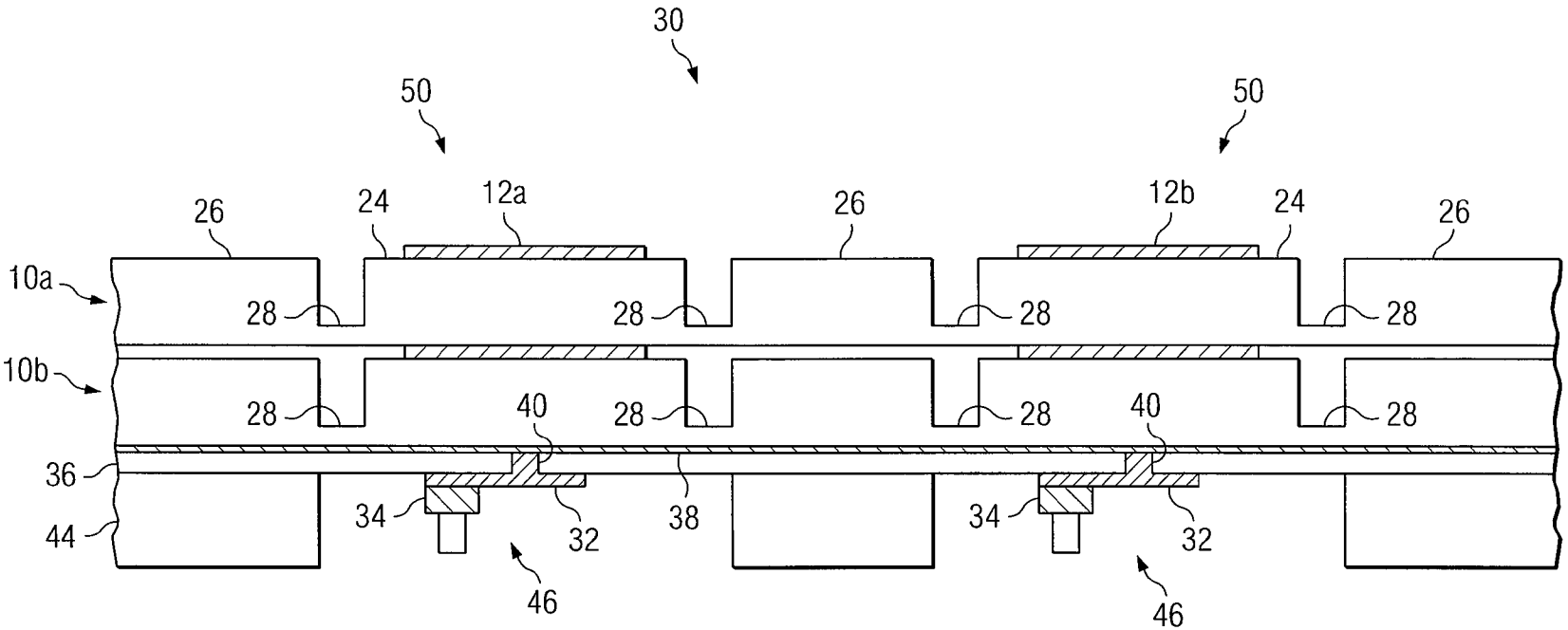
FIG. 2 is a cross-sectional side view of one embodiment of a patch antenna that may be formed using two radiating layers of FIGS. 1A and 1B.

FIG. 2 is a cross-sectional, side elevational view of a patch antenna 30 that is formed using two radiating layers 10*a* and 10*b* disposed adjacent one another and a microstrip feed line 32 electrically coupled to a surface mount connector 34 disposed on a side of radiating layer 10*b* opposite its radiating element 12. Surface mount connector 34 may be any suitable type of connector, such as an SubMiniature version B (SMB) connector, for coupling patch antenna 30 to a receiver or transmitter. In the particular embodiment shown, radiating elements 12 are driven by a microstrip feed line 32; however, radiating elements may be driven by any type feed line that electrically couples radiating elements 12 to a transmitter or receiver.

Microstrip feed line 32 may be formed on a relatively thin dielectric layer 36. In the particular embodiment shown, dielectric layer 36 is approximately 10 mils (10 micro-inches) in thickness and each of the two radiating layers 10 are approximately 100 mils (100 micro-inches) in thickness. Other embodiments, however, may incorporate dielectric layers 36 and/or radiating layers 10 having other thicknesses to tailor the performance parameters of patch antenna 30.

A ground plane 38 may be provided on dielectric layer 36 opposite microstrip feed line 32. A hole 40 is formed in ground plane 38 through which an electric field may be formed on radiating elements 12 when microstrip feed line 32 is excited with an electrical signal. The hole 40 is generally aligned with the radiating element 12 such that electric fields generated by microstrip feed line 32 and ground plane 38 are converted to electro-magnetic energy by radiating elements 12*a* and 12*b*.

Patch antenna 30 also includes a base layer 44 that is configured with holes 46 to provide access to surface mount connectors 34. In some embodiments, holes 46 may be plated with a metalized coating along their edge. As shown, patch antenna 30 is configured with two radiating layers 10, however, patch antenna 30 may incorporate any quantity of radiating layers 10. Additional radiating layers 10 may enable further tailoring of various performance characteristics of patch antenna 30.

Radiating elements 12 disposed adjacent one another with microstrip feed lines 32 form antenna elements 50 that may be operable to transmit and/or receive electro-magnetic energy. Two antenna elements 50 are shown; however, patch antenna 30 may include any number of antenna elements 50 that may be arranged in any two-dimensional fashion. Conductive coating on inner perimeter sidewall 18 and/or outer perimeter sidewall 20 isolate electric fields formed in either antenna element 50 from one another.

Figure 3:
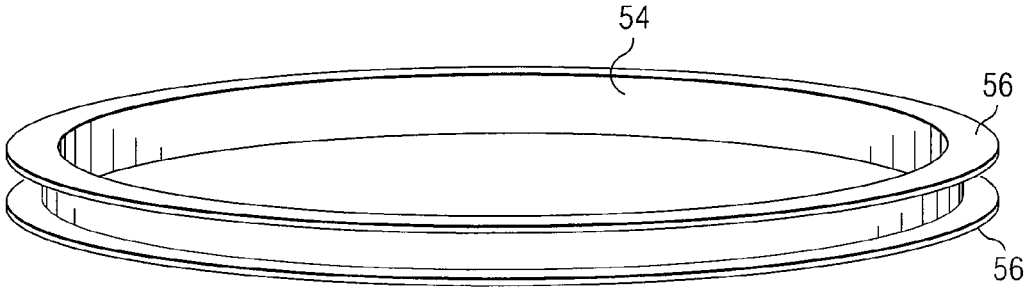
FIG. 3 is a perspective view of a conductive coating that may be used with the radiating layer of FIGS. 1A and 1B.

FIG. 3 shows one embodiment of a conductive coating 54 of the radiating layer 10 with the dielectric substrate 14, radiating element 12, and tabs 28 removed. In this particular embodiment, conductive coating includes metalized rings 56 on both side of the dielectric substrate 14. In one embodiments, these metalized rings 56 may provide electromagnetic interference (EMI) isolation to other metalized rings 56 on additional radiating layers 10.

Figure 4:
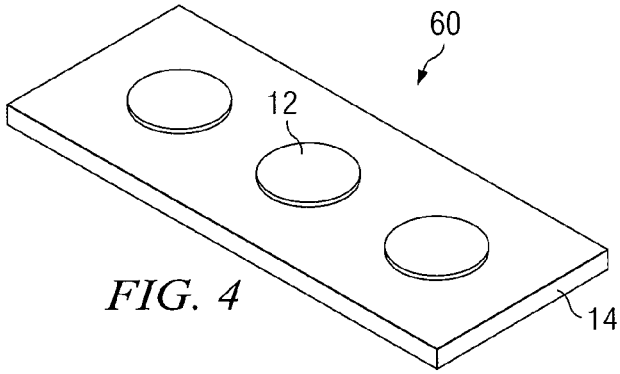
FIG. 4 is a perspective view of another embodiment of a radiating layer in which the metalized coating other than the radiating elements is removed during the etching process.

FIG. 4 is a perspective view of another embodiment of a radiating layer 60 that may be incorporated with the patch antenna 30 of FIG. 2. Radiating layer 60 is shown after a number of radiating elements 12 are formed due to an etching process and before moats 16 are scribed around each of the radiating elements 12. In this particular embodiment, all of the conductive coating other than the radiating elements 12 are removed during the etching process.

Figure 5:
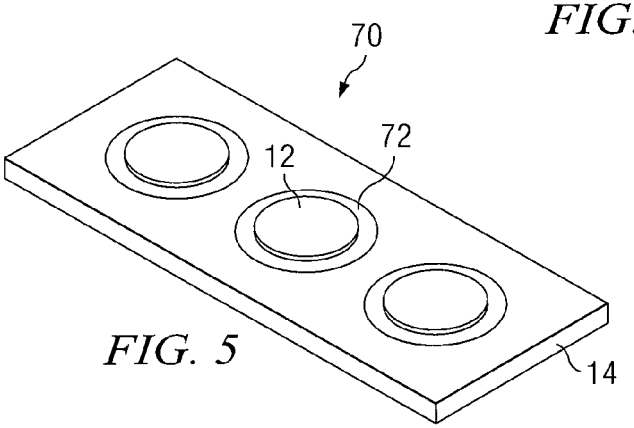
FIG. 5 is a perspective view of another embodiment of a radiating layer in which the region proximate the moats have been etched away leaving radiating elements that are each surrounded by a metalized boundary region.

FIG. 5 is a perspective view of another embodiment of a radiating layer 70 that may be incorporated with the patch antenna 30 of FIG. 2. Radiating layer 70 is shown after a number of radiating elements 12 are formed due to an etching process and before moats 16 are scribed around each of the radiating elements 12. In this particular embodiment, the region proximate the moats have been etched away leaving radiating elements 12 that are each surrounded by a metalized boundary region 72.

Modifications, additions, or omissions may be made to patch antenna 30 without departing from the scope of the disclosure. For example, the inner substrate portion 24 and corresponding radiating elements 12 may be entirely removed from one or more antenna elements 50 to tailor its operation. As used in this document, "each" refers to each member of a set or each member of a subset of a set.

Figure 6:
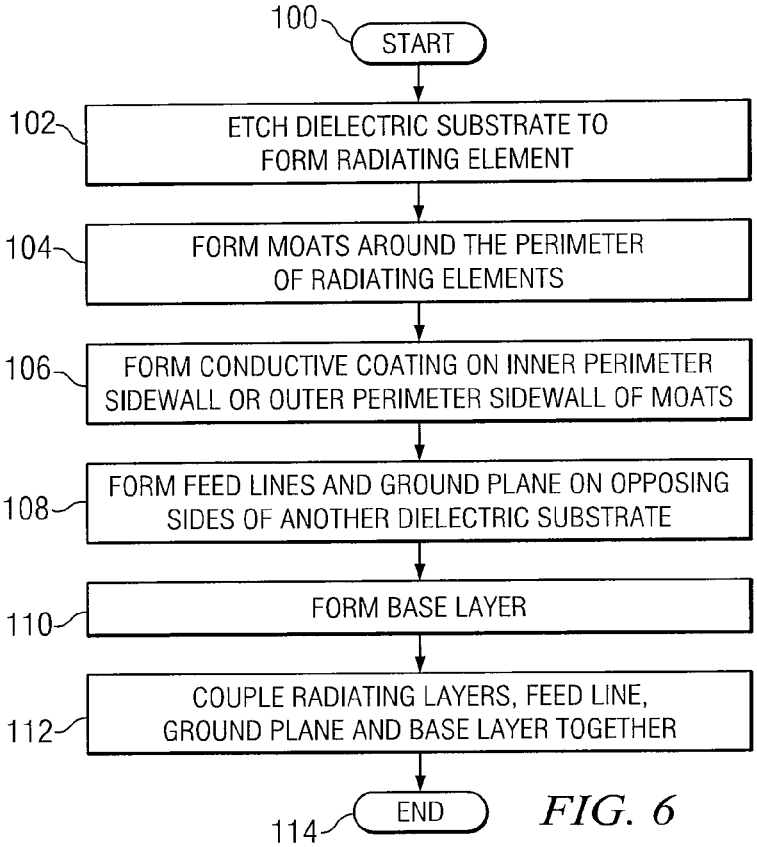
FIG. 6 is a flowchart showing a series of actions that may be performed to manufacture the patch antenna of FIG. 2.

FIG. 6 shows one embodiment of a series of actions that may be performed to manufacture the patch antenna 30. In act 100, the process is initiated.

In act 102, one or more dielectric substrates 14 that are copper cladded on at least one side are etched to form one or more radiating elements 12. In one embodiment, all copper other than the one or more radiating elements is removed. In another embodiments, only a portion of the copper proximate radiating elements is removed to form a metalized boundary region 72.

In act 104, one or more moats 16 are formed around the perimeter of each corresponding one or more radiating elements 12. Moats 16 may be formed in dielectric layer 14 using any commonly known process, such as by a routing procedure. The routing process may leave a relatively small portion of the dielectric layer 14 to form tabs 28 that maintain inner substrate portion 24 in a fixed physical relation to outer substrate portion 26.

In act 106, a conductive coating is formed on the inner perimeter sidewall 18 or the outer perimeter sidewall 20 of moats 16. In some embodiments, the conductive coating may be formed on the inner perimeter sidewall and the outer perimeter sidewall 20.

In act 108, one or more feed lines 32 corresponding to the one or more radiating elements 12 and ground plane 38 are formed on either side of dielectric layer 36. Holes 40 may also be etched in ground plane 38 proximate each microstrip feed line 32. In one embodiment, surface mount connectors 34 may also be mounted on dielectric layer 36 to provide electrical coupling to feed lines 32.

In act 110, base layer 44 is formed of a dielectric material by routing holes 46 corresponding to size and location to each radiating element 12.

In act 112, the one or more radiating layers 10, dielectric layer 36, and base layer 44 are attached together using a suitable adhesive.

In act 114, the patch antenna 30 has been manufactured and thus the process ends.

Modifications, additions, or omissions may be made to the method without departing from the scope of the disclosure. The method may include more, fewer, or other acts. For example, although surface mount connectors 34 are soldered to microstrip feed lines 32, any suitable type of connectors may be provided to electrically couple feed lines 32 to external circuitry.

Although several embodiments have been illustrated and described in detail, it will be recognized that substitutions and alterations are possible without departing from the spirit and scope of the present disclosure, as defined by the following claims.

What is claimed is:

1. A patch antenna comprising:

a stacked plurality of radiating layers, each radiating layer comprising:

a planar-shaped dielectric layer;

a radiating element formed on a first side of the dielectric layer;

a single, contiguous, substantially empty moat formed in the dielectric layer around the perimeter of the radiating element forming a single continuous inner perimeter sidewall and single continuous outer perimeter sidewall;

a plurality of tabs extending between the inner perimeter sidewall and the outer perimeter sidewall, the plurality of tabs operable to maintain an inner substrate portion of the dielectric layer in a fixed physical relation to an outer substrate portion of the dielectric layer;

a conductive coating disposed on the inner perimeter sidewall and the outer perimeter sidewall; and a second planar-shaped dielectric layer having a third side and an opposing fourth side, the second dielectric layer comprising:

a microstrip feed line disposed on the third side; and a ground plane disposed on the fourth side, the ground plane having a hole between at least one of the radiating elements and the microstrip feed line.

2. A patch antenna comprising:

at least two stacked radiating layers, each comprising:

a planar-shaped dielectric layer;

a radiating element formed on a first side of the dielectric layer;

a single, contiguous, substantially empty moat formed in the dielectric layer around the perimeter of the radiating element forming a single continuous inner perimeter sidewall and a single continuous outer perimeter sidewall;

a conductive coating disposed on the inner perimeter sidewall or the outer perimeter sidewall; and a feed line disposed on a second side of the dielectric layer.

3. The patch antenna of claim 2, further comprising a plurality of tabs extending between the inner perimeter sidewall and the outer perimeter sidewall of at least one of said radiating layers, the plurality of tabs operable to maintain an inner substrate portion in a fixed physical relation to an outer substrate portion, the moat forming the inner substrate portion and the outer substrate portion.

4. The patch antenna of claim 3, further comprising a metalized boundary formed on a first side of the outer substrate portion using an etching process.

5. The patch antenna of claim 2, wherein the conductive coating is disposed on the inner perimeter sidewall and the outer perimeter sidewall of at least one of said radiating layers.

6. The patch antenna of claim 2, further comprising a ground plane disposed on the second side of at least one of the dielectric layers and electrically isolated from the feed line, the ground plane having a hole between the radiating element and the feed line.

7. The patch antenna of claim 6, further comprising a surface mount connector attached to the second side of the dielectric layer and electrically coupled to the feed line.

8. The patch antenna of claim 2, wherein a second side of the second dielectric layer is located adjacent to the first side of the first dielectric layer such that the radiating element of the second radiating layer is aligned with the radiating element of the first radiating layer.

9. The patch antenna of claim 2, wherein of at least one of the dielectric layers comprises FR4.

10. The patch antenna of claim 2, wherein the feed line comprises a microstrip feed line.

11. A method for manufacturing an antenna comprising:

forming at least two stacked radiating layers, each radiating layer formed by:

etching one or more radiating elements on a first side of a dielectric layer;

forming a single, contiguous, substantially empty moat in the dielectric layer around the perimeter of each of the one or more radiating elements, the moat forming a single continuous inner perimeter sidewall and a single continuous outer perimeter sidewall;

forming a conductive coating on the inner perimeter sidewall or the outer perimeter sidewall; and coupling a feed line to a second side of the dielectric layer.

12. The method of claim 11, wherein forming the moat around the perimeter of the each of the one or more radiating elements comprises forming a plurality of tabs between the inner perimeter sidewall and the outer perimeter sidewall.

13. The method of claim 11, wherein forming the conductive coating on the inner perimeter sidewall or the outer perimeter sidewall comprises forming the conductive coating on the inner perimeter sidewall and the outer perimeter sidewall.

14. The method of claim 11, further comprising forming the feed line on a first side of a dielectric substrate and a ground plane on a second side of the dielectric substrate, wherein coupling the feed line to the second side of the dielectric layer comprises coupling the dielectric substrate to the dielectric layer.

15. The method of claim 11, further comprising electrically coupling a surface mount connector to the feed line.

16. The method of claim 11, further comprising etching a metalized boundary layer on the first side of the dielectric layer.

* * * * *